US010244803B2

(12) United States Patent
Powell

(10) Patent No.: US 10,244,803 B2
(45) Date of Patent: Apr. 2, 2019

(54) ATHLETIC SHORTS GARMENT APPARATUS WITH IMPROVED INTERFEMORAL GUSSET AND SURROUNDING MODESTY PANEL

(71) Applicant: SparkleZone, LLC, Lakeland, FL (US)

(72) Inventor: Leah Laake Powell, Lakeland, FL (US)

( * ) Notice: Subject to any disclaimer, the term of this patent is extended or adjusted under 35 U.S.C. 154(b) by 633 days.

(21) Appl. No.: 14/326,627

(22) Filed: Jul. 9, 2014

(65) Prior Publication Data

US 2016/0007662 A1 Jan. 14, 2016

(51) Int. Cl.
*A41D 1/08* (2018.01)
*A41D 1/00* (2018.01)

(52) U.S. Cl.
CPC ..... *A41D 1/08* (2013.01); *A41D 1/002* (2013.01); *A41D 2600/10* (2013.01)

(58) Field of Classification Search
CPC ..... A41D 1/08; A41D 1/002; A41D 2600/10; A41D 1/14; A41D 15/02; A41D 1/06
USPC ..... 2/228, 71, 76, 406, 407, 236
See application file for complete search history.

(56) References Cited

U.S. PATENT DOCUMENTS 2,034,312 A * 3/1936 Rubin ..... A41D 1/06 2/228
2,299,681 A * 10/1942 Childs ..... A41D 1/08 2/404
2,513,108 A * 6/1950 Naeger ..... A41D 1/14 2/212
3,392,733 A * 7/1968 Blair ..... A41C 1/003 450/104
3,399,679 A * 9/1968 Barg ..... A41B 9/08 2/71
4,551,994 A * 11/1985 Vailati ..... A41F 9/02 66/190
4,649,574 A * 3/1987 Michels ..... A41F 9/025 2/235
4,907,298 A * 3/1990 Lisowski ..... A41D 15/02 2/212
5,598,586 A * 2/1997 Munjone ..... A41D 1/08 2/228
D378,317 S * 3/1997 Wike ..... D2/712
5,675,842 A * 10/1997 Schaefer ..... A41F 9/02 2/221
5,724,679 A * 3/1998 Hans ..... A41D 27/20 2/228
5,806,100 A * 9/1998 De Scandiffio ..... A41D 1/14 2/211

(Continued)

*Primary Examiner* — Alissa L Hoey
(74) *Attorney, Agent, or Firm* — Cygnet IP Law, P.A.; Stephen W. Aycock, II

(57) ABSTRACT

The present invention provides a new and useful athletic shorts garment apparatus with improved interfemoral gusset and surrounding modesty panel. This invention is believed to be useful by offering an apparatus which stays in place when in use, does not ride-up the legs, prevents chafing, provides a flared modesty panel that is flattering, accommodates all hip sizes and hides the body shape and contours of the user, has readily accessible large pockets for carrying items, has a double gusset located between the legs to prevent splitting that can occur from a single seam, allows for the addition of a drawstring, and is reversible. The aforementioned existing apparatus in the field is indicated to be used by athletes, most commonly women who are runners, walkers, tennis players and the like.

11 Claims, 7 Drawing Sheets

(56) References Cited

U.S. PATENT DOCUMENTS 5,956,774 A * 9/1999 Mackley ..... A41D 1/08 2/227
6,138,282 A * 10/2000 Follese ..... A41B 9/14 2/220
6,148,443 A * 11/2000 Maastricht ..... A41D 1/08 2/227
6,401,250 B1 * 6/2002 McNabb ..... A41D 1/06 2/227
6,665,882 B1 * 12/2003 Pedrick ..... A41D 7/005 2/228
7,017,193 B2 * 3/2006 Auger ..... A41B 9/023 2/403
D556,089 S * 11/2007 Lobel ..... D11/221
7,849,522 B2 * 12/2010 Roux ..... A41D 1/04 2/227
D661,871 S * 6/2012 Savage ..... D2/742
8,460,265 B1 * 6/2013 Calender ..... A61F 13/49006 2/401
D690,229 S * 9/2013 Pena ..... D11/221
8,561,213 B2 * 10/2013 Howell ..... F41H 1/02 2/2.5
9,021,615 B2 * 5/2015 Cockram ..... A41D 1/06 2/236
D754,418 S * 4/2016 Caine ..... D2/742
2004/0216218 A1 * 11/2004 McCarthy ..... A41D 1/08 2/228
2005/0066408 A1 * 3/2005 Varela ..... A41D 27/12 2/69
2007/0101481 A1 * 5/2007 Stokesbary ..... A41D 7/005 2/211
2007/0157367 A1 * 7/2007 Kerkhoff ..... A41D 1/14 2/227
2007/0261703 A1 * 11/2007 Gheneva ..... A41D 27/205 131/231
2008/0184459 A1 * 8/2008 Barnes ..... A41D 27/205 2/249
2008/0216212 A1 * 9/2008 Burgess ..... A41D 1/06 2/228
2009/0038046 A1 * 2/2009 Moore ..... A41D 1/08 2/67
2009/0094725 A1 * 4/2009 Smith ..... A41D 27/205 2/69
2009/0139013 A1 * 6/2009 Sapowycz ..... A41D 1/005 2/247
2009/0300818 A1 * 12/2009 Waite ..... A41D 1/14 2/76
2011/0023216 A1 * 2/2011 O'Leary ..... A41B 9/001 2/400
2011/0209267 A1 * 9/2011 Rush ..... A41D 1/08 2/228
2011/0219514 A1 * 9/2011 Scheininger ..... A41B 9/14 2/113
2012/0090076 A1 * 4/2012 Kenney ..... A41D 15/02 2/212
2013/0014311 A1 * 1/2013 Chapuis ..... A41D 1/08 2/69
2013/0185840 A1 * 7/2013 Grozdev ..... A41D 13/0012 2/69
2013/0239294 A1 * 9/2013 Clement ..... A41D 1/08 2/228
2013/0305433 A1 * 11/2013 Hedrick ..... A41D 1/22 2/220
2014/0053322 A1 * 2/2014 Zamler ..... A41B 9/04 2/407
2014/0196194 A1 * 7/2014 Clarke ..... A41D 1/14 2/237
2015/0128331 A1 * 5/2015 Grosse ..... A41D 13/0017 2/400
2015/0257459 A1 * 9/2015 Cockram ..... A41D 1/08 2/212

* cited by examiner

ATHLETIC SHORTS GARMENT APPARATUS WITH IMPROVED INTERFEMORAL GUSSET AND SURROUNDING MODESTY PANEL

CROSS-REFERENCE TO RELATED APPLICATIONS

Not Applicable.

TECHNICAL FIELD

The present invention is in the technical field of athletic garments. More particularly, the present invention is in the technical field of athletic garments utilizing improved gussets. More particularly, the present invention is in the technical field of athletic garments utilizing improved gussets and modesty panels.

BACKGROUND OF THE INVENTION

Participation in athletic pursuits is an endemic part of human life across the globe. Whether on a recreational or professional level, participants have noted the importance of appropriate and corresponding attire for the desired sports activity. Specially designed sports apparel that conforms to the needs of the particular user and activity has created a multi-billion dollar industry around the world and is most easily observed at interdisciplinary events such as the Olympic Games. At events such as this, one may observe the plethora of materials, shapes and designs for the different participants and athletic disciplines. One suit may be designed to combat weather effects, while another might be designed to decrease drag, and finally some may be designed to maximize comfort, flexibility or performance.

In the sports where the athlete is required to run, common problems continue to plague designers and wearers of the corresponding attire. Most commonly, these garments continually shift or "ride-up" the runner's legs while in use. Also, the construction creates hot spots or other artifacts that lead to painful chafing—most commonly between the legs. Makers of the existing art resort to using rubber, latex or silicon strips to "stick" the short legs to the wearer's skin. Not only does this approach not successfully combat the problems in the art, over time these materials deteriorate and lose elasticity. Users also report that the current materials can cause allergic reactions or restrict circulation.

In the applicant's experience there is a need for an athletic shorts garment apparatus with improved interfemoral gusset and surrounding modesty panel which: i) stays in place when in use, ii) does not ride-up the legs, iii) prevents chafing, iv) provides a flared modesty panel that is flattering, accommodates all hip sizes and hides the body shape and contours of the user, v) has readily accessible large pockets for carrying items, vi) has a double gusset located between the legs to prevent splitting that can occur from a single seam, vii) allows for the addition of a drawstring, and viii) is reversible. The device of the present invention is believed to accomplish all of the foregoing objectives.

SUMMARY OF THE INVENTION

The present invention provides a new and useful athletic shorts garment apparatus with improved interfemoral gusset and surrounding modesty panel. This invention is believed to be useful by offering an apparatus which stays in place when in use, does not ride-up the legs, prevents chafing, provides a flared modesty panel that is flattering, accommodates all hip sizes and hides the body shape and contours of the user, has readily accessible large pockets for carrying items, has a double gusset located between the legs to prevent splitting that can occur from a single seam, allows for the addition of a drawstring, and is reversible. The device of the present invention is believed to accomplish all of the foregoing objectives. The aforementioned existing apparatus in the field is indicated to be used by athletes, most commonly women who are runners, walkers, tennis players and the like.

Current athletic garments which cover the lower portion of the athlete when worn are most commonly a form of short pants or leggings. While these garments have become ubiquitous, the current art has been unsuccessful in resolving several recurring problems in the existing art. These artifacts arise while the user often engages in an activity with repetitive motions such as running or cycling.

Because of the anatomy of the user, areas of friction develop which are most commonly between the thighs and yield undesired results in the garment and on the user. One such negative effect is colloquially termed "riding up." In this particular event, friction from repetitive motions cause the garment to travel upward along the leg, and most commonly along the inner thighs. This deformation of the garment can cause mild discomfort and bunching in the interfemoral or inner-pelvic area thereby exposing the once covered skin along the thigh.

Subsequent and serial to the first problem in the art, the newly exposed skin becomes subject to surface abrasion—most often with the neighboring leg and body structures. This rubbing often leads to chafing. Chafing can be very painful and destructive to the subject tissues. Injuries can include mild redness to blistering and bleeding. This is often accompanied with a burning and stinging sensation in the damaged area. It is also shown that if the chafed area is left untreated, the area can be subject to infection and require the application of antibiotic ointments.

Also, the current art does not offer a means for the wearer to exhibit modesty if desired. In the current art, exercise clothing is often skin tight. Although this characteristic tightness has some favorable byproducts, like decreasing drag and attempting to combat the aforementioned problems of chafing and riding up, the skin tight garment often immodestly displays the user's physical anatomy underneath. Therefore the present inventor has developed a new and useful apparatus to address the problems in the current art.

In one of its basic embodiments the present invention comprises a waistband attached to a shorts garment complex which comprises a left leg and right leg structure with cuffs at the end of each and an improved interfemoral gusset there between. The cuffs and improved interfemoral gusset each exhibit properties which combat problems in the current art—specifically chafing and "riding up" of the garment while worn by the user.

In one of its basic embodiments the apparatus further comprises a modesty panel, which is akin to a skirt, that is attached at the nexus of the waistband and the shorts garment complex. This modesty panel therefore covers the legs and other anatomy of the user.

Thus the present invention is believed to provide a new and useful athletic shorts garment apparatus with improved interfemoral gusset and surrounding modesty panel which: i) stays in place when in use, ii) does not ride-up the legs, iii) prevents chafing, iv) provides a flared modesty panel that is flattering, accommodates all hip sizes and hides the body shape and contours of the user, v) has readily accessible large pockets for carrying items, vi) has a double gusset located between the legs to prevent splitting that can occur from a single seam, vii) allows for the addition of a drawstring, and viii) is reversible. The device of the present invention is believed to accomplish all of the foregoing objectives.

Further features and objectives of the present invention will become apparent from the following detailed descriptions and the accompanying drawings.

DETAILED DESCRIPTION OF THE INVENTION

As described above, the present invention provides a new and useful athletic shorts garment apparatus with improved interfemoral gusset and surrounding modesty panel. This invention is believed to be useful by offering an apparatus which stays in place when in use, does not ride-up the legs, prevents chafing, provides a flared modesty panel that is flattering, accommodates all hip sizes and hides the body shape and contours of the user, has readily accessible large pockets for carrying items, has a double gusset to prevent splitting that can occur from a single seam, allows for the addition of a drawstring, and is reversible. The following description and accompanying drawings disclose at least one version of such a device.

Figure 1:
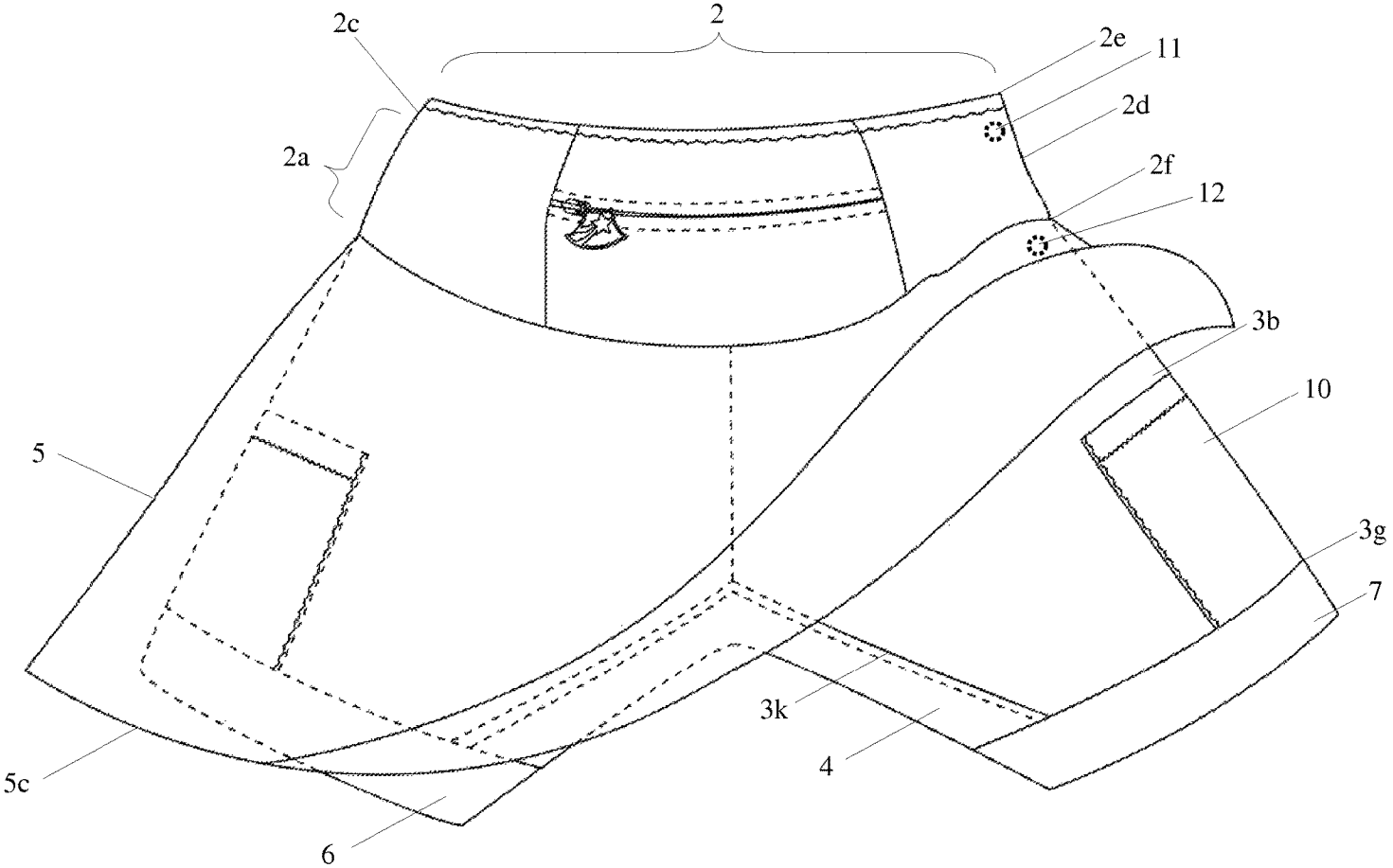
FIG. 1 is an anterior view of an athletic shorts garment apparatus with improved interfemoral gusset and surrounding modesty panel according to the present invention with modesty panel 105 partially raised to show underlying shorts garment apparatus features.
Figure 2:
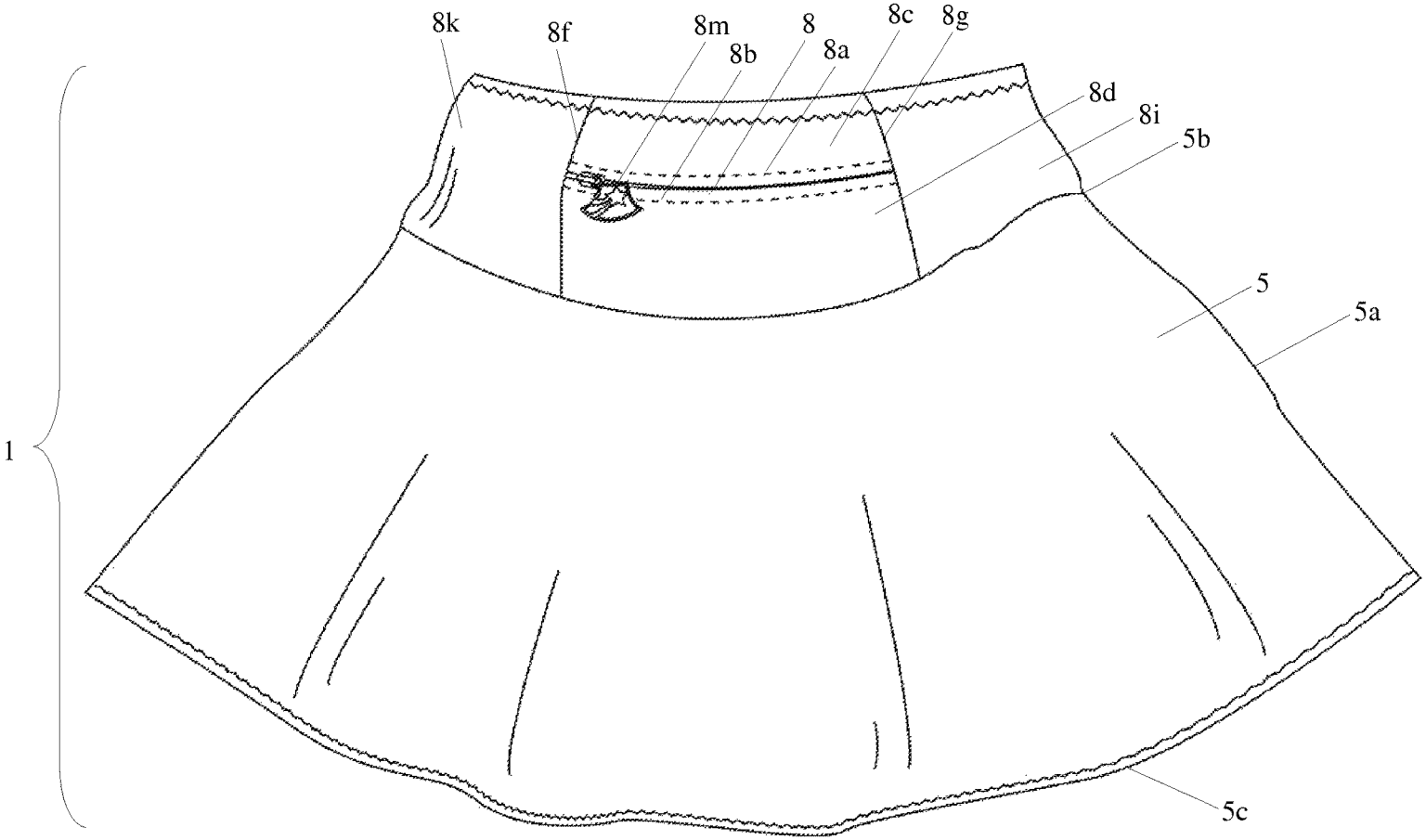
FIG. 2 is an anterior view of the apparatus according to the present invention with modesty panel lowered.
Figure 3:
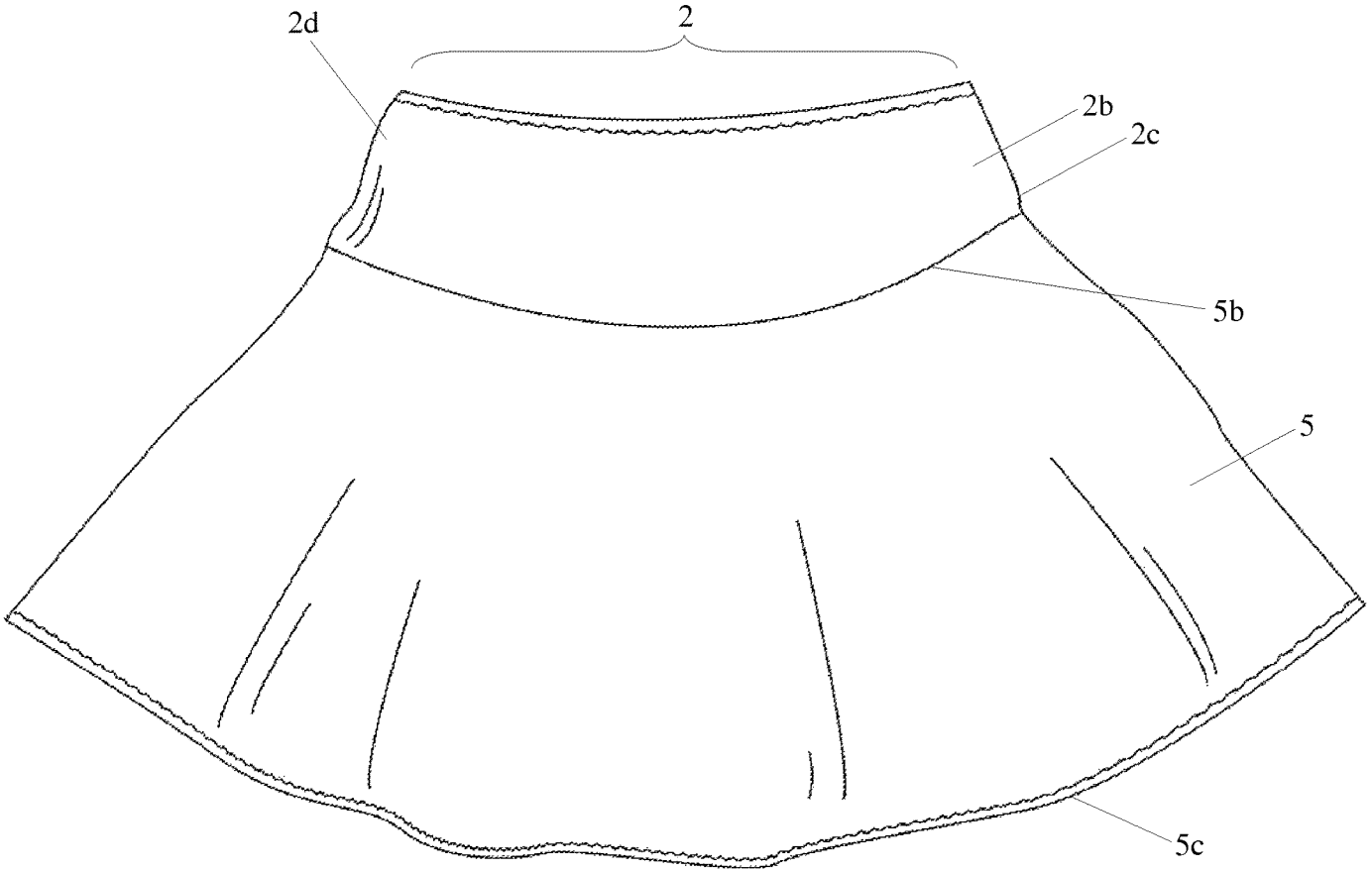
FIG. 3 is a posterior view of the apparatus according to the present invention with modesty panel lowered.
Figure 4:
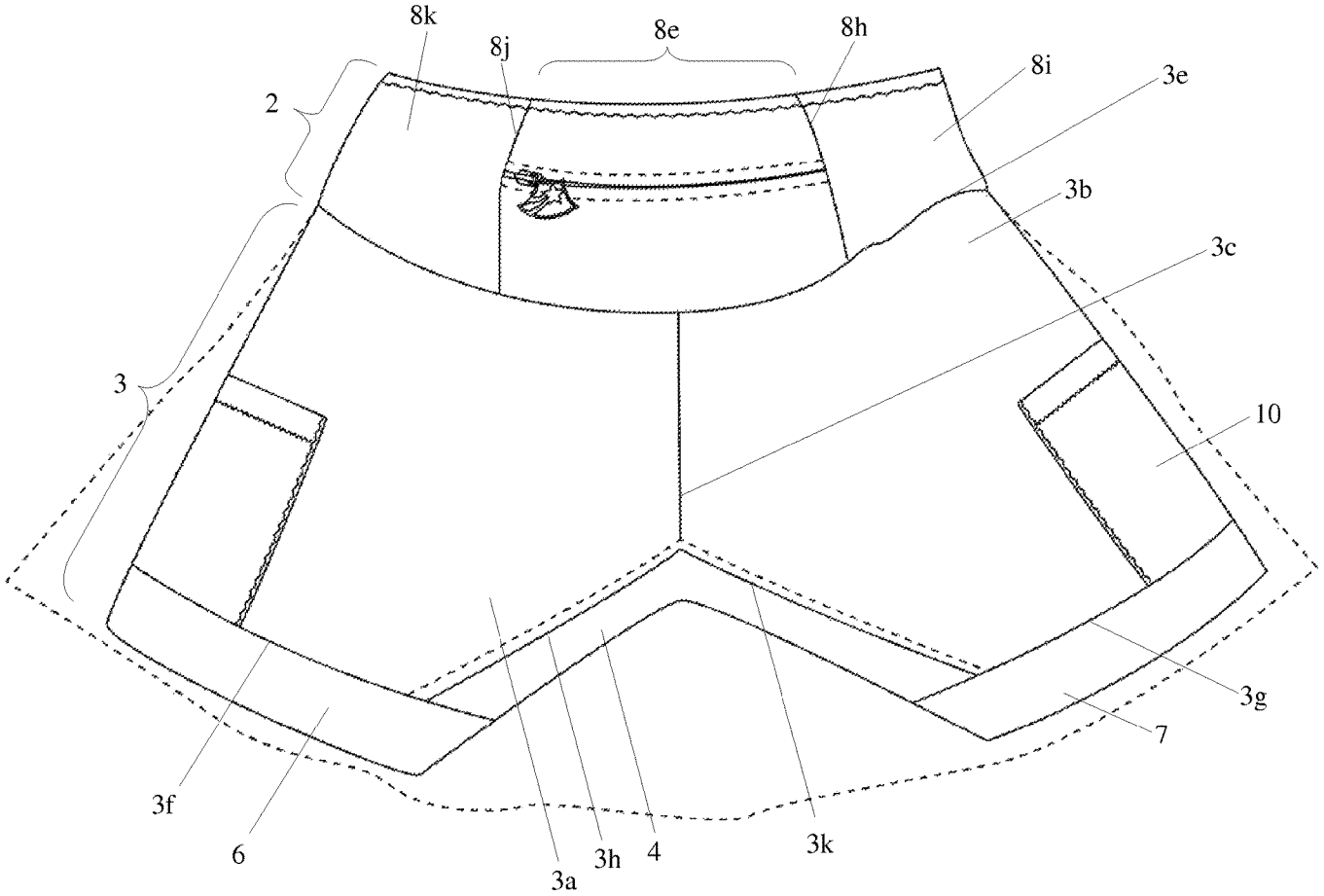
FIG. 4 is an anterior detail view of the apparatus according to the present invention showing the features of the underlying shorts garment.
Figure 5:
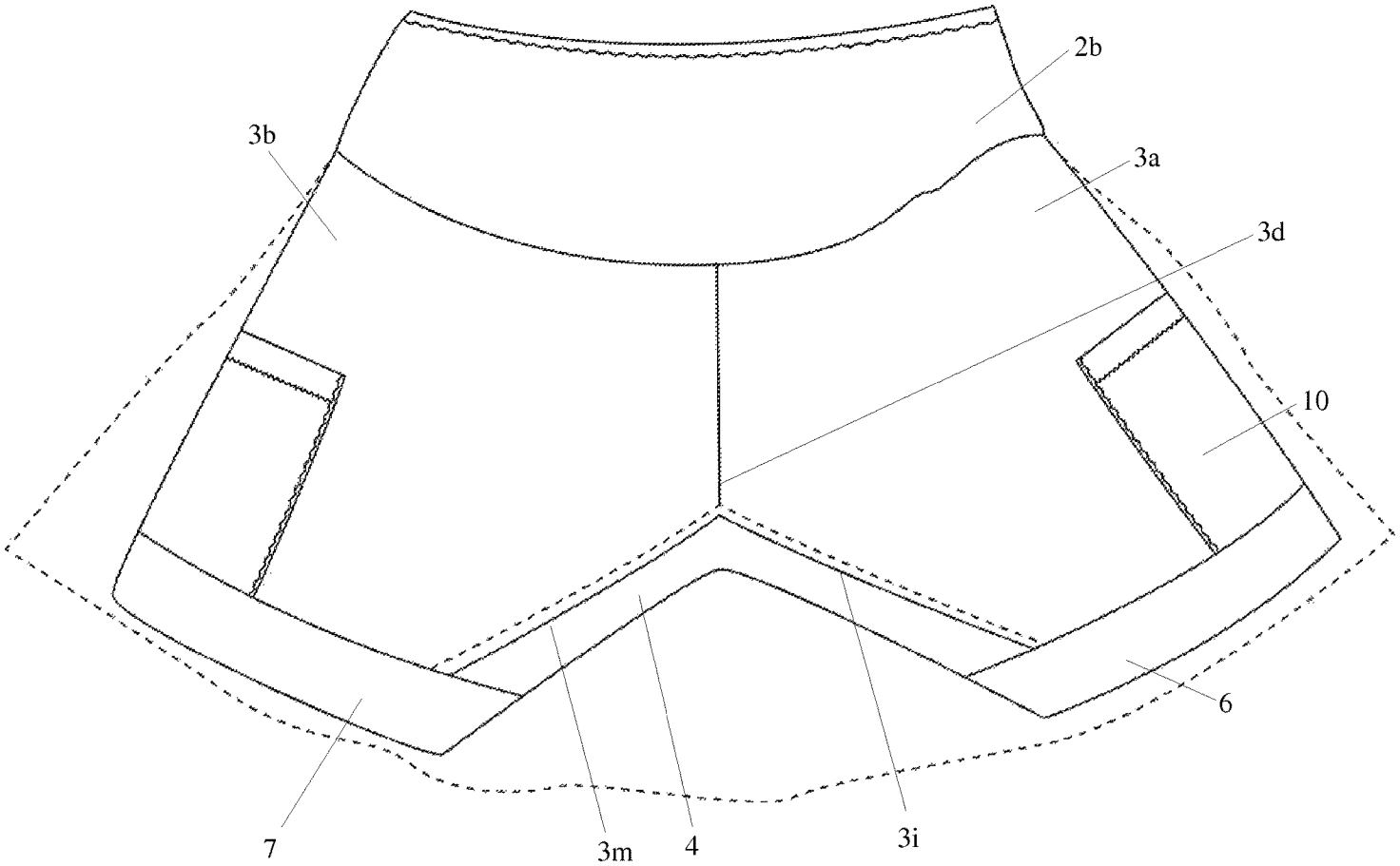
FIG. 5 is a posterior detail view of the apparatus according to the present invention showing the features of the underlying short garment.
Figure 6:
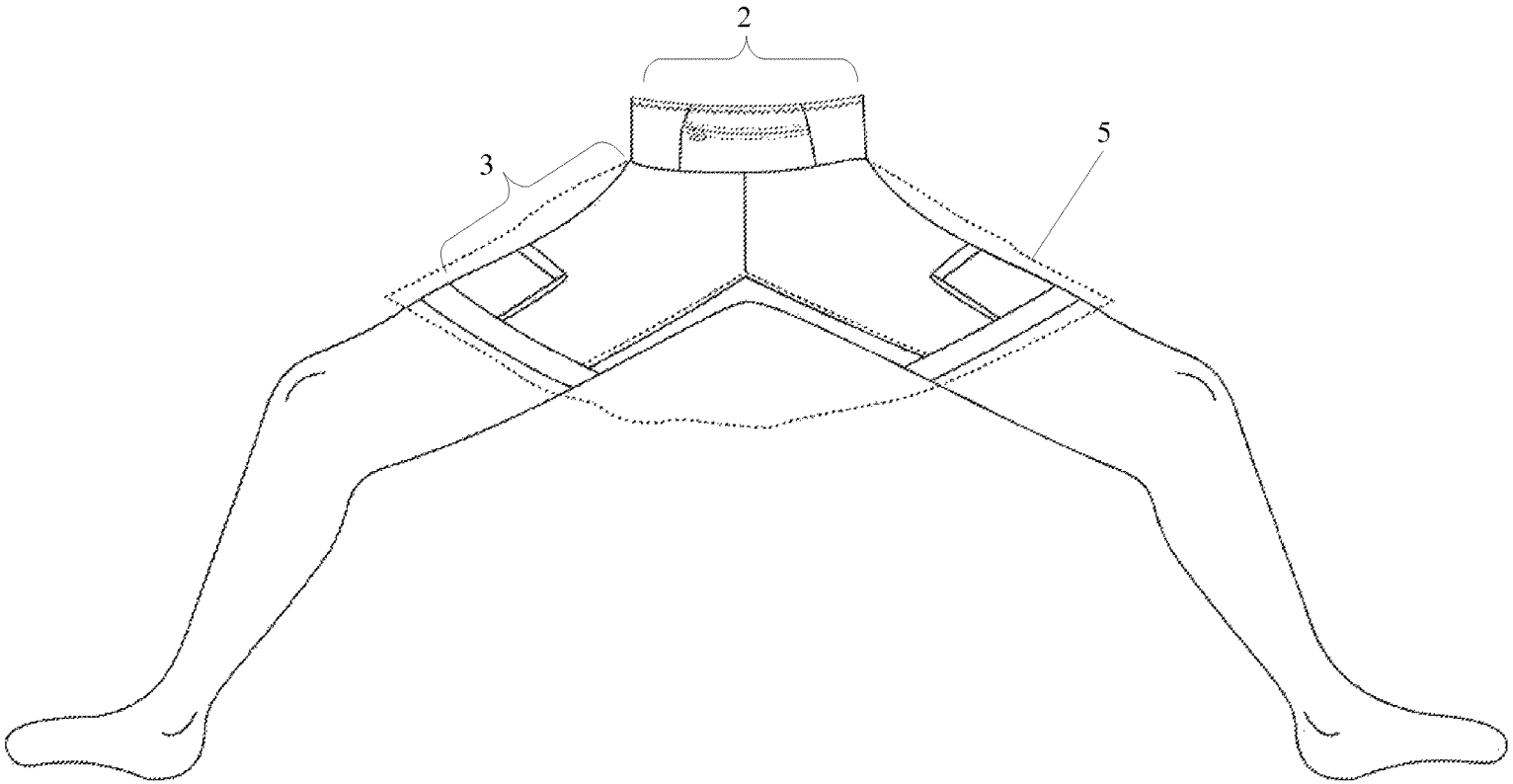
FIG. 6 is an anterior detail view of the apparatus according to the present invention shown in its 115 environment, worn by an athlete, and showing the fit of the shorts garment, location of the improved interfemoral gusset and modesty panel when in use.
Figure 7:
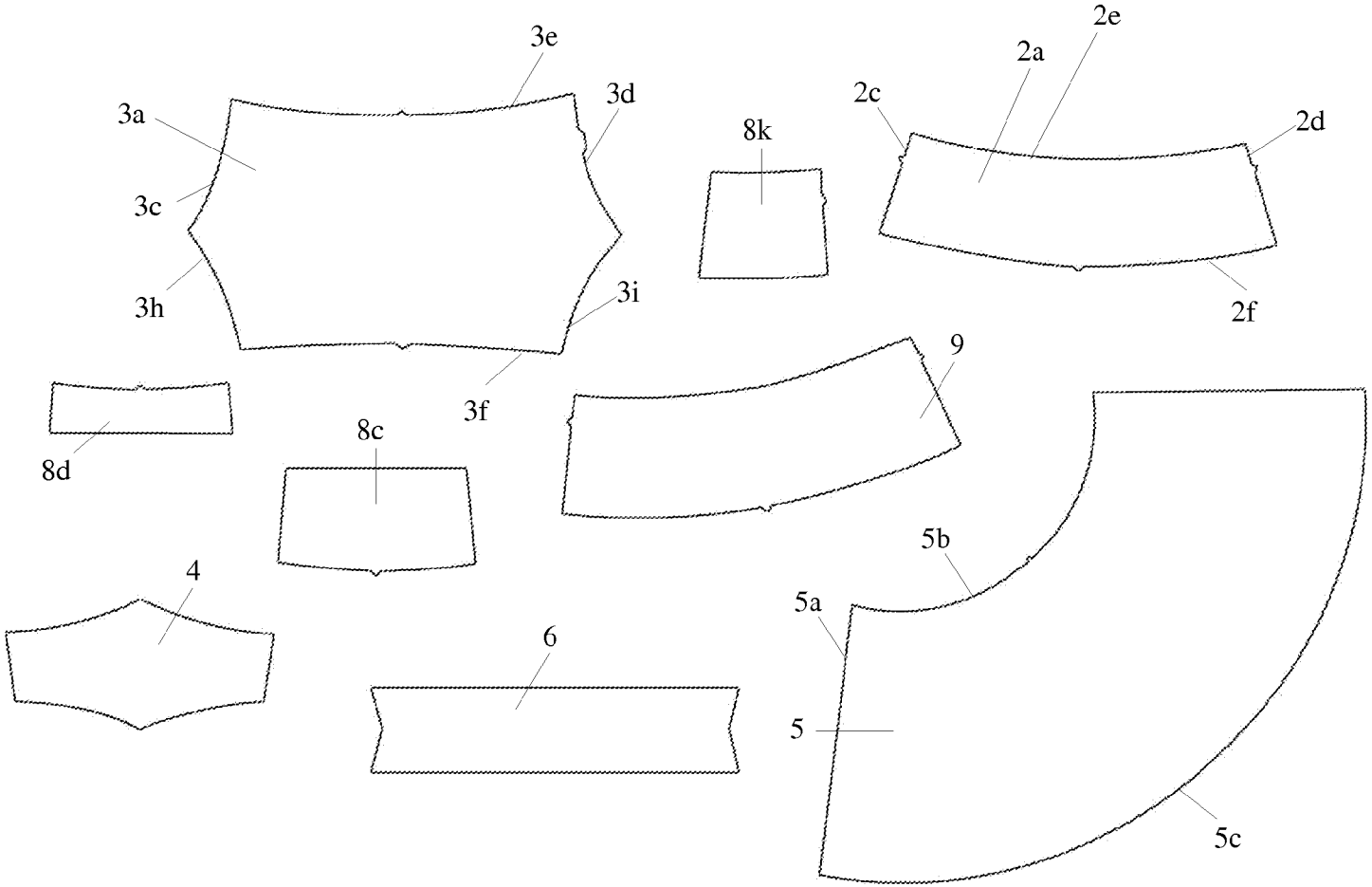
FIG. 7 is an exploded view of the apparatus according to the present invention showing the unassembled components of the apparatus.

Referring now to the invention in more detail, in FIG. 1 through FIG. 7 there is shown an athletic shorts garment apparatus with improved interfemoral gusset and surrounding modesty panel shown generally 1. The apparatus comprises a waistband complex 2 having an anterior face 2*a* connected, usually by stitching or sewing with thread, to a posterior face 2*b* along a left waistband seam 2*c* and a right waistband seam 2*d*. The waistband complex 2 exhibits a top 135 shorts complex seam edge 2*e* and a bottom shorts complex seam edge 2*f*.

The apparatus also comprises a shorts garment complex 3 which is made from a left leg structure 3*a* and a right leg structure 3*b* which are connected along a central anterior seam 3*c* and a central posterior seam 3*d*. When connected the said shorts garment complex 3 exhibits a top shorts garment complex seam edge 3*e*, a left leg structure bottom shorts garment seam edge 3*f* and a right leg structure bottom shorts garment seam edge 3*g*.

The left leg structure 3*a* of the apparatus also has an anterior left improved interfemoral gusset seam edge 3*h* and a posterior left improved interfemoral gusset seam edge 3*i*. Likewise, the right leg structure 3*b* has an anterior right improved interfemoral gusset seam edge 3*k* and a posterior right improved interfemoral gusset seam edge 3*m*.

The said top shorts garment complex seam edge 3*e* is attached to the bottom waistband complex seam edge 2*f* of the waistband complex.

The apparatus further comprises an improved interfemoral gusset 4 which is attached to the shorts garment complex 3 along the anterior right improved interfemoral gusset seam edge 3*k*, the posterior right improved interfemoral gusset seam edge 3*m*, the anterior left improved interfemoral gusset seam edge 3*h*, and the posterior left improved interfemoral gusset seam edge 3*i*. The improved interfemoral gusset 4 is a generally oblong and hexagonal in shape and when the apparatus is worn is situated between the legs of the wearer. The improved interfemoral gusset 4 can also be angled and double-layered to minimize chaffing, shifting, and riding-up of the apparatus when worn by the user, most typically an athlete.

Further, the apparatus comprises a modesty panel 5. The modesty panel 5, when unassembled, presents generally in a semicircular shape. When assembled and connected along a side seam 5*a* the modesty panel 5 creates a conical or skirt shape which has a top modesty panel seam edge 5*b* and a bottom modesty panel hem edge 5*c*. The top modesty panel seam edge 5*b* is attached to the waistband complex 2 of the apparatus. When assembled, the modesty panel 5 is flared and accommodates all hip sizes and be flattering to the figure of the user.

An angled left leg cuff 6 is folded over and attached to the left leg structure bottom seam edge 3*f* and attached improved interfemoral gusset 4. An angled right leg cuff 7 is folded over and attached to the right leg structure bottom seam edge 3*g* and attached improved interfemoral gusset 4.

In at least one embodiment of the present invention, the anterior face 2*a* of the waistband complex 2 further comprises a zipper pocket complex 8*e*. The zipper pocket complex 8*e* comprises a zipper 8 presented horizontally which has a top zipper edge 8*a* and a bottom zipper edge 8*b*. The zipper 8, which may have an ornamental zipper pull 8*m*, is attached to a upper zipper pocket panel 8*c* along the top zipper edge 8*a* and a lower zipper pocket panel 8*d* along the bottom zipper edge 8*b* and thereby collectively creating a zipper pocket complex 8*e*. The zipper pocket complex 8*e* exhibits a left zipper pocket complex edge 8*f* and a right zipper pocket complex edge 8*g*, and is attached to a left side 8*h* of a right waistband panel 8*i* along the left zipper pocket complex edge 8*g* and to a right side 8*j* of a left waistband panel 8*k* along the right zipper pocket complex edge 8*f*. The apparatus 1 can be worn with the zipper pocket complex 8*e* worn to the front or the back of the user.

In at least one embodiment of the present invention, the waistband complex 2 further comprises a waistband complex inner lining 9 attached along the top waistband complex seam edge 2*e* and the bottom waistband complex seam edge 2*f*. Therefore an interior void or pocket is created between the waistband complex inner lining 9 and the anterior face 2*a* and the posterior 180 face 2*b* of the waistband complex 2.

In at least one embodiment of the present invention, the shorts garment complex 3 further comprises a plurality of pockets 10 attached to the right leg structure 3*b*, the left leg structure 3*a*, or both. These pockets 10 and the waistband zipper pocket complex 8*e*, if present, can be strategically placed, conceal contents therein, as well as be flattering to the wearer and readily accessible.

Although the apparatus can be made out of any material, it is envisioned that an embodiment exists where at least the left leg structure 3*a*, the right leg structure 3*b*, the angled left leg cuff 6, the angled right leg cuff 7, the improved interfemoral gusset 4, and waistband complex inner lining 9 if present are made of a wicking 4-way material such as spandex. The properties of this material maximize the new, useful, and non-obvious features of the invention—specifically combatting chaffing, shifting and riding-up of the garment when worn by an athlete. Also, the top seam edge 2*e* of the waistband complex 2 can be made using anti-roll elastic. It is envisioned that the garment is designed and created without the use of rubber, silicon or latex strips, which have been shown to be ineffective in the prior art.

In at least one embodiment of the present invention, the waistband complex 2 further comprises a plurality of drawstring holes 11 to allow the addition of a drawstring (not shown). Also, the modesty panel 5 may comprise at least one perforation 12 to allow a cord such as an earphone cord to pass through.

It is also envisioned that the placement or printing of a decorative element on the exterior of the apparatus will be practiced. The decorative element can be a pattern, text, an image, advertisement or equivalent.

The dimensions of the apparatus can be any size that will accommodate the body shapes and sizes of a variety of wearers.

Although the present invention has been described in considerable detail with reference to certain preferred versions thereof, other versions are possible. Therefore the spirit and scope of the appended claims should not be limited to the description of the preferred versions contained therein.

The reader's attention is directed to all papers and documents which are filed concurrently with this specification and which are open to public inspection with this specification, and the contents of all such papers and documents are incorporated herein by reference.

All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. As for "means for" elements, the applicant intends to encompass within the language any structure presently existing or developed in the future that performs the same function. The invention should therefore not be limited by the above described embodiment, method, and examples, but by all embodiments and methods within the scope and spirit of the invention.

What is claimed is:

1. An athletic shorts garment apparatus with improved interfemoral gusset and surrounding modesty panel comprising:

a) a waistband complex having an anterior face connected to a posterior face along a left waistband seam and a right waistband seam, said waistband complex having a top shorts complex seam edge and a bottom shorts complex seam edge;

b) a shorts garment complex having a left leg structure and a right leg structure connected along a central anterior seam and a central posterior seam, said shorts garment complex having a top shorts garment complex seam edge, a left leg structure bottom shorts garment seam edge and a right leg structure bottom shorts garment seam edge, said left leg structure having an anterior left interfemoral gusset seam edge and a posterior left interfemoral gusset seam edge, said right leg structure having an anterior right interfemoral gusset seam edge and a posterior right interfemoral gusset seam edge, said top shorts garment complex seam edge is attached to the bottom shorts complex seam edge of the waistband complex;

c) an improved interfemoral gusset comprising two continuous panels of a same shape in a double-layered arrangement connected at boundary edges, wherein the improved interfemoral gusset is attached to the shorts garment complex along the anterior right interfemoral gusset seam edge, the posterior right interfemoral gusset seam edge, the anterior left interfemoral gusset seam edge, and the posterior left interfemoral gusset seam edge, said improved interfemoral gusset having an oblong hexagonal shape;

d) a modesty panel having a top modesty panel seam edge and a bottom modesty panel hem edge, where said top modesty panel seam edge is attached to the bottom waistband complex seam edge;

e) an angled left leg cuff piece having a fold forming a dual layer cuff attached to the left leg structure bottom shorts garment seam edge and attached to the improved interfemoral gusset and having a diameter at a bottommost edge that is smaller than a diameter at a topmost edge of the angled left leg cuff piece that is attached to the left leg structure bottom shorts garment seam edge; and f) an angled right leg cuff piece having a fold forming a dual layer cuff attached to the right leg structure bottom shorts garment seam edge and attached to the improved interfemoral gusset and having a diameter at a bottommost edge that is smaller than a diameter at a topmost edge of the angled right leg cuff piece that is attached to the right leg structure bottom shorts garment seam edge.

2. The apparatus as in claim 1, wherein the anterior face of the waistband complex further comprises a zipper attached horizontally, having a top zipper edge and a bottom zipper edge, said zipper attached to an upper zipper pocket panel along the top zipper edge and a lower zipper pocket panel along the bottom zipper edge and thereby forming a zipper pocket complex with a left zipper pocket complex edge and a right zipper pocket complex edge, said zipper complex attached to a left side of a right waistband panel along the right zipper pocket complex edge, said zipper complex attached to a right side of a left waistband panel along the left zipper pocket complex edge.

3. The apparatus as in claim 2 wherein the zipper further comprises an ornamental zipper pull.

4. The apparatus as in claim 1, wherein the shorts garment complex further comprises a pocket attached to the right leg structure.

5. The apparatus as in claim 1, wherein the shorts garment complex further comprises a pocket attached to the left leg structure.

6. The apparatus as in claim 1, where the left leg structure, the right leg structure, the angled left leg cuff, the angled right leg cuff, and the improved interfemoral gusset are made of a wicking 4-way material.

7. The apparatus as in claim 1, further comprising placement or printing of a decorative element on an exterior of the apparatus, said decorative element including one or more of a pattern, text, an image, logo or advertisement.

8. The apparatus as in claim 1, wherein the top seam edge of the waistband complex includes anti-roll elastic.

9. The apparatus as in claim 1 wherein the modesty panel further comprises at least one perforation to allow a cord such as an earphone cord to pass through.

10. The apparatus as in claim 1, wherein the waistband complex further comprises a waistband complex inner lining attached along the top seam edge and the bottom seam edge of the waistband complex, thereby creating an interior void between the waistband complex inner lining and the anterior face of the waistband complex.

11. The apparatus as in claim 10, wherein the waistband complex inner lining is made of a wicking 4-way material.

* * * * *